US012799772B2

(12) United States Patent
Viberg et al.

(10) Patent No.: US 12,799,772 B2
(45) Date of Patent: Nov. 17, 2026

(54) MESH PANEL HOLDER

(71) Applicant: WORXSAFE AB, Östersund (SE)

(72) Inventors: Olov Viberg, Östersund (SE); Sima Brunner, Ås (SE); Bengt Jönsson, Ås (SE)

(73) Assignee: WORXSAFE AB, Östersund (SE)

( * ) Notice: Subject to any disclaimer, the term of this patent is extended or adjusted under 35 U.S.C. 154(b) by 240 days.

(21) Appl. No.: 18/693,123

(22) PCT Filed: Sep. 22, 2021

(86) PCT No.: PCT/EP2021/076106
§ 371 (c)(1),
(2) Date: Mar. 18, 2024

(87) PCT Pub. No.: WO2023/046281
PCT Pub. Date: Mar. 30, 2023

(65) Prior Publication Data
US 2024/0384562 A1 Nov. 21, 2024

(51) Int. Cl.
*E04H 17/16* (2006.01)
*E04G 21/32* (2006.01)

(52) U.S. Cl.
CPC ..... *E04H 17/17* (2021.01); *E04G 21/3223* (2013.01); *E04H 17/163* (2013.01)

(58) Field of Classification Search
CPC ..... E04H 17/16; E04H 17/161; E04H 17/163; E04H 17/165; E04H 17/166; E04H 17/17;
(Continued)

(56) References Cited

U.S. PATENT DOCUMENTS 3,822,850 A * 7/1974 Elias ..... E04G 21/3233 248/200.1
3,946,992 A * 3/1976 Elias ..... E04G 21/3233 248/231.71
(Continued)

FOREIGN PATENT DOCUMENTS

CA 2314670 A1 * 1/2002
DE 4425500 A1 * 2/1996 ..... E04H 17/16
(Continued)

OTHER PUBLICATIONS

Office Action Summary mailed Aug. 12, 2025, issued in corresponding UAE Patent Application No. P2024-00682, filed Mar. 21, 2024, 7 pages.
(Continued)

*Primary Examiner* — Jonathan P Masinick
(74) *Attorney, Agent, or Firm* — Christensen O'Connor Johnson Kindness PLLC

(57) ABSTRACT

A mesh panel holder (1) for an edge protection barrier system (30) comprising mesh panels (33) supported on posts (31) by means of the mesh panel holders. The mesh panel holder has a post attachment member (2) and a mesh panel support (3) attached to the post attachment member. The mesh panel support has a mesh panel retainer (4) arranged to pivot between at least a first locked position and a second locked position at different pivotal angles. The mesh panel retainer (4) is arranged to, in the first locked position, enable a mesh panel to be received at the mesh panel support, and, in the second locked position, prevent a received mesh panel from being unintentionally removed from the mesh panel holder. The mesh panel holder includes a resilient locking member (5), wherein unlocking of the mesh panel retainer from the first and second locked positions requires operation of the resilient locking member.

14 Claims, 12 Drawing Sheets

(58) Field of Classification Search
CPC . E04H 17/1473; E04G 21/32; E04G 21/3204; E04G 21/3214; E04G 21/3223; E04G 21/3233; E04G 21/3242; E04G 5/06; E04G 5/067; E04G 2005/148; E04G 7/28
See application file for complete search history.

(56) References Cited

U.S. PATENT DOCUMENTS

| | | | | |
|---|---|---|---|---|
| 3,980,278 | A * | 9/1976 | Elias | E04G 21/3233 256/59 |
| 4,558,851 | A * | 12/1985 | Nakayama | E04H 17/161 256/73 |
| 6,336,623 | B1 | 1/2002 | McCarthy | |
| 7,740,233 | B1 * | 6/2010 | Larsen | E04H 17/161 256/45 |
| 8,367,918 | B2 * | 2/2013 | Reyes | G10D 13/02 84/411 R |
| 8,607,844 | B2 * | 12/2013 | Meza | E05B 65/006 160/368.1 |
| 9,631,397 | B2 * | 4/2017 | Bertato | E04F 11/1834 |
| 9,822,548 | B1 * | 11/2017 | Harkins | E01F 15/088 |
| 10,053,880 | B2 * | 8/2018 | Melic | E04H 17/20 |
| 10,274,691 | B2 * | 4/2019 | Janssens | F16B 2/185 |
| 10,372,151 | B2 * | 8/2019 | Stuart | G05G 5/22 |
| 10,982,454 | B2 * | 4/2021 | Melic | E04G 21/3223 |
| 11,105,114 | B2 * | 8/2021 | Presti | E04H 17/1417 |
| 11,261,617 | B2 * | 3/2022 | Saltijeral | E04H 17/166 |
| 11,421,441 | B2 * | 8/2022 | Howell | E04H 17/20 |
| 11,805,757 | B1 * | 11/2023 | Klein | A01K 3/005 |
| 11,891,831 | B1 * | 2/2024 | Hudson | E04H 17/16 |
| 12,006,720 | B2 * | 6/2024 | Stucchi | E04H 17/161 |
| 12,098,567 | B2 * | 9/2024 | Baltz, Jr. | E04H 17/1488 |
| 2007/0074917 | A1 * | 4/2007 | Jaenke | F16B 2/065 180/65.1 |
| 2008/0135821 | A1 | 6/2008 | Svedberg | |
| 2012/0080266 | A1 * | 4/2012 | Brock | E04G 5/06 182/115 |
| 2012/0138758 | A1 * | 6/2012 | Graber | E04H 17/1417 248/221.11 |
| 2016/0002936 | A1 * | 1/2016 | Cox | E04G 1/152 403/376 |
| 2016/0333602 | A1 * | 11/2016 | Veness | B60R 21/026 |
| 2017/0044794 | A1 * | 2/2017 | Morrow | E04H 17/161 |
| 2017/0284136 | A1 * | 10/2017 | Ramsey | E06B 11/022 |
| 2019/0040640 | A1 | 2/2019 | Rainville | |
| 2021/0108430 | A1 * | 4/2021 | Melic | E04G 21/3266 |

FOREIGN PATENT DOCUMENTS

| | | | | |
|---|---|---|---|---|
| DE | 10000701 | A1 * | 7/2001 | B24B 55/02 |
| DE | 10111272 | A1 * | 9/2002 | E04H 17/161 |
| DE | 102006009367 | A1 * | 9/2007 | E05D 3/02 |
| DE | 102019122106 | B3 * | 12/2020 | E04H 17/161 |
| EP | 0835974 | A1 * | 4/1998 | E04H 17/163 |
| EP | 1219839 | A1 * | 7/2002 | E04H 17/161 |
| FR | 2659400 | A1 * | 9/1991 | B63H 8/22 |
| FR | 2956688 | A1 * | 8/2011 | E04H 17/268 |
| GB | 2537848 | A | 11/2016 | |
| GB | 2571432 | A | 8/2019 | |
| KR | 200410996 | Y1 * | 3/2006 | E04G 5/14 |
| KR | 20070000464 | U * | 4/2007 | F16B 7/04 |
| KR | 20090108281 | A * | 10/2009 | E04G 21/32 |
| KR | 20090119339 | A * | 11/2009 | E04G 21/3223 |
| WO | WO-03040496 | A1 * | 5/2003 | E04H 17/161 |
| WO | WO-2015181824 | A1 * | 12/2015 | E04H 17/161 |

OTHER PUBLICATIONS

International Search Report and Written Opinion mailed Jun. 2, 2022, issued in corresponding International Patent Application No. PCT/EP2021/076106, filed Sep. 22, 2021, 9 pages.

* cited by examiner

MESH PANEL HOLDER

TECHNICAL FIELD

The present disclosure relates to the field of edge protection barrier systems, and more particularly to a mesh panel holder for use in such an edge protection barrier system.

BACKGROUND

Edge protection barrier systems are typically used at construction sites to prevent people and tools from falling to ground during work at height. An edge protection barrier system comprises posts and mesh panels, which hang on the posts. A mesh panel is a fence element having a peripheral frame and a grid of wires, i.e. a mesh, attached to the frame. The posts may be tall enough to be arranged between a floor and a ceiling or may be engaged with merely the floor. The posts are provided with mesh panel holders, which support the mesh panels. Typically, a mesh panel holder has a hook shaped portion that supports the mesh panel. This is a simple way of supporting the mesh panels and avoiding a need of tools for fastening the mesh panels. However, it is difficult to design a hook to fulfil both high security demands as regards the ability to prevent inadvertent removal of the mesh panel and enable a simple mounting of the mesh panel.

SUMMARY

The present disclosure seeks to at least partly remedy the above discussed problems. To achieve this a mesh panel holder, an edge protection barrier system and a method of installing an edge protection barrier system according to the independent claims are provided. Further embodiments are provided in the dependent claims.

According to a first aspect of the present disclosure, there is provided a mesh panel holder for an edge protection barrier system comprising mesh panels supported on posts by means of mesh panel holders. The mesh panel holder comprises a post attachment member and a mesh panel support attached to the post attachment member. The mesh panel support comprises a mesh panel retainer arranged to pivot between at least a first position and a second position at different pivotal angles, The mesh panel retainer is arranged to, in the first locked position, enable a mesh panel to be received at the mesh panel support, and, in the second locked position, prevent a received mesh panel from being unintentionally removed from the mesh panel holder. The mesh panel support comprises a resilient locking member, wherein unlocking of the mesh panel retainer from the first and second locked positions requires operation of the resilient locking member.

In some embodiments, in a mounted state, the mesh panel retainer, in a mounted state, extends generally horizontally in the first position, and extends generally vertically in the second position. Thereby, the mounting of the mesh panel is facilitated.

In some embodiments, the mesh panel support comprises a support member attached to the post attachment member and arranged to support the mesh panel, and the mesh panel retainer is pivotally connected with the support member at an end thereof.

In some embodiments, the mesh panel retainer comprises a first engagement portion and the support member comprises a second engagement portion arranged to engage with the first engagement portion.

In some embodiments, the resilient locking member comprises a locking element, which comprises the second engagement portion. The locking element is releasably engaged with the mesh panel retainer at first and second lock portions, which are comprised in the first engagement portion of the mesh panel retainer, in the first and second locked positions, respectively.

In some embodiments, the resilient locking member further comprises a spring element engaged with the locking element. The spring element is arranged to keep the locking element in engagement with the mesh panel retainer in the first and second locked positions.

In some embodiments, the locking element is reciprocally movably arranged at the support member.

In some embodiments, the first engagement portion comprises a generally circular portion rotatably connected with the support member, and the locking portions comprise recesses spaced along a periphery of the generally circular portion. The locking element comprises protrusions extending into the recesses in the first and second locked positions.

In some embodiments, the resilient locking member comprises resilient legs of the mesh panel retainer, wherein the resilient legs are arranged to be pushed towards each other to unlock the mesh panel retainer and enable pivoting thereof.

In some embodiments, the post attachment member comprises a post bracket arranged to extend around at least a part of a periphery of a post.

In some embodiments, the post attachment member comprises a clamping member connected with the post bracket and arranged to clamp the post bracket at the post.

In some embodiments, the post bracket comprises a mouth for receiving the post into the post bracket, and wherein the clamping member further comprises a gate element movable between a closed position where the gate element closes the mouth and an open position where the mouth is open and allows the post to pass the mouth.

In some embodiments, the post bracket is resilient, at least at the mouth, and the gate element comprises a pin having a thread at one end thereof and a head at the other end thereof and is arranged to, in the closed position, clamp the post bracket at the post by being rotated.

In some embodiments, the clamping member comprises an eccentric lock arranged at the mouth of the post bracket.

In some embodiments, the clamping member comprises a lever pivotally attached, at a pivot connection, with the post bracket at the mouth, wherein the gate member is pivotally connected with the lever and eccentrically connected with the lever with respect to the pivot connection.

According to a second aspect of the present disclosure, there is provided an edge protection barrier system comprising at least one mesh panel supported on posts by means of mesh panel holders as mentioned above.

According to a third aspect of the present disclosure, there is provided a method of installing an edge protection barrier system comprising mesh panels supported on posts by means of mesh panel holders according as mentioned above. The method comprises:

- mounting several posts on a floor;
- mounting at least one mesh panel holder on each post;
- setting the mesh panel retainers in the first locked position;
- mounting each mesh panel on two adjacent posts, thereby receiving each mesh panel at the mesh panel supports; and
- pivoting the mesh panel retainers to the second locked position.

BRIEF DESCRIPTION OF THE DRAWINGS

Exemplifying embodiments will be described below with reference to the accompanying drawings, in which.

Figure 1:
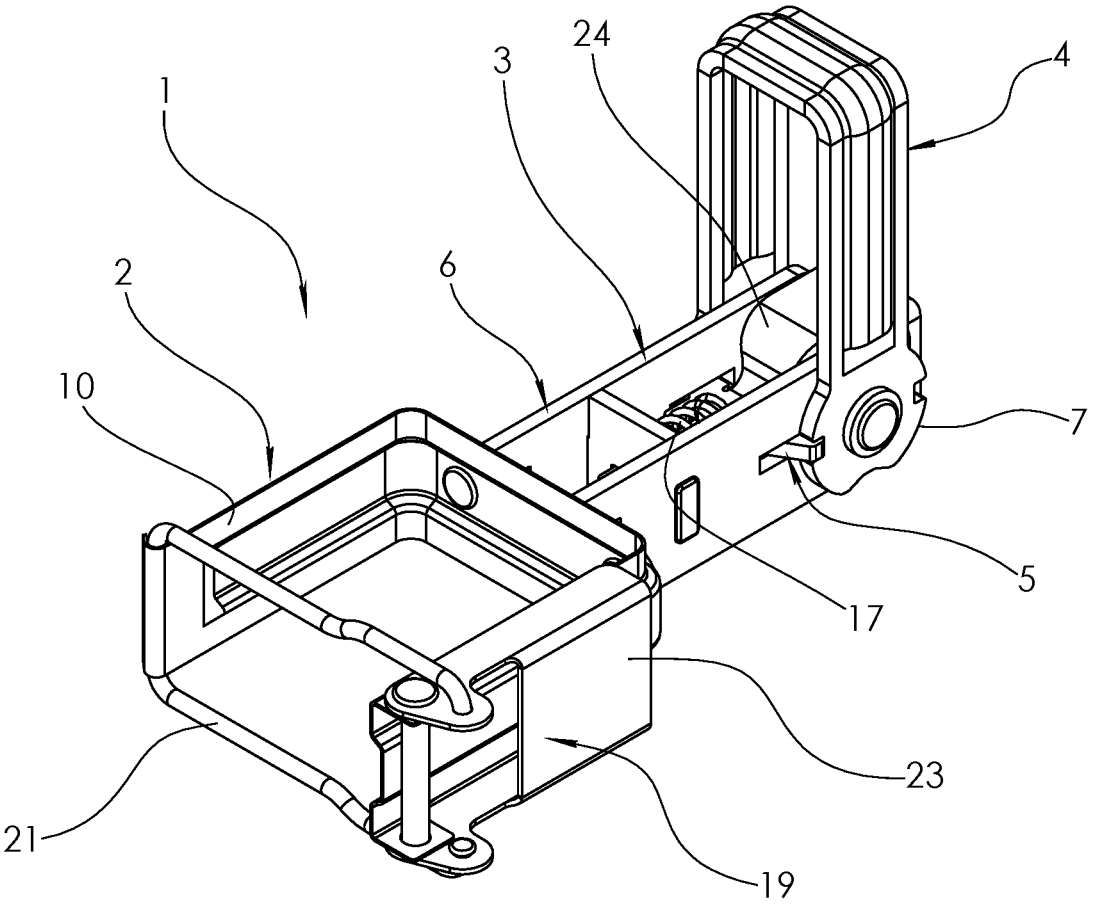
FIG. 1 is a schematic perspective view of an embodiment of a mesh panel holder according to the present disclosure.

In the drawings, like reference numerals will be used for like elements unless stated otherwise. Unless explicitly stated to the contrary, the drawings show only such elements that are necessary to illustrate the example embodiments, while other elements, in the interest of clarity, may be omitted or merely suggested. As illustrated in the figures, the sizes of elements and regions may be exaggerated for illustrative purposes and, thus, are provided to illustrate the general structures of the embodiments.

DETAILED DESCRIPTION

Figure 2:
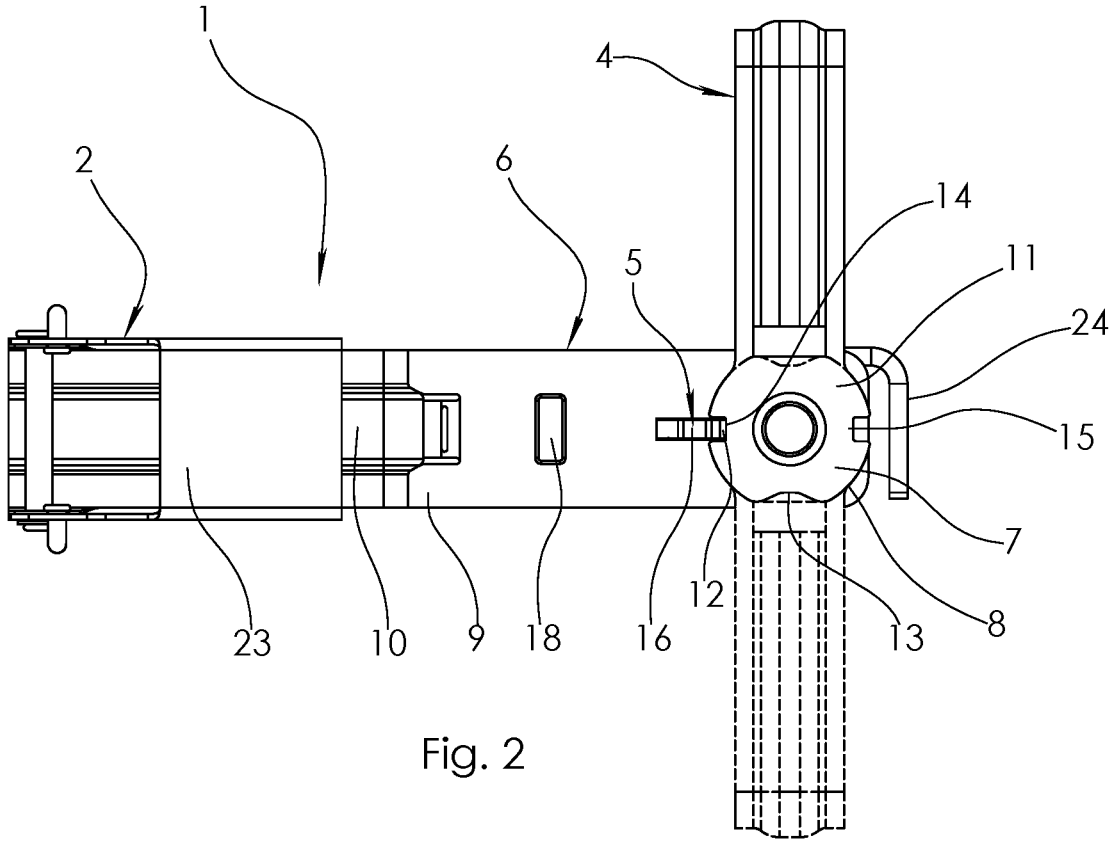
FIGS. 2 to 4 are further views of the mesh panel holder shown in FIG. 1.
Figure 3:
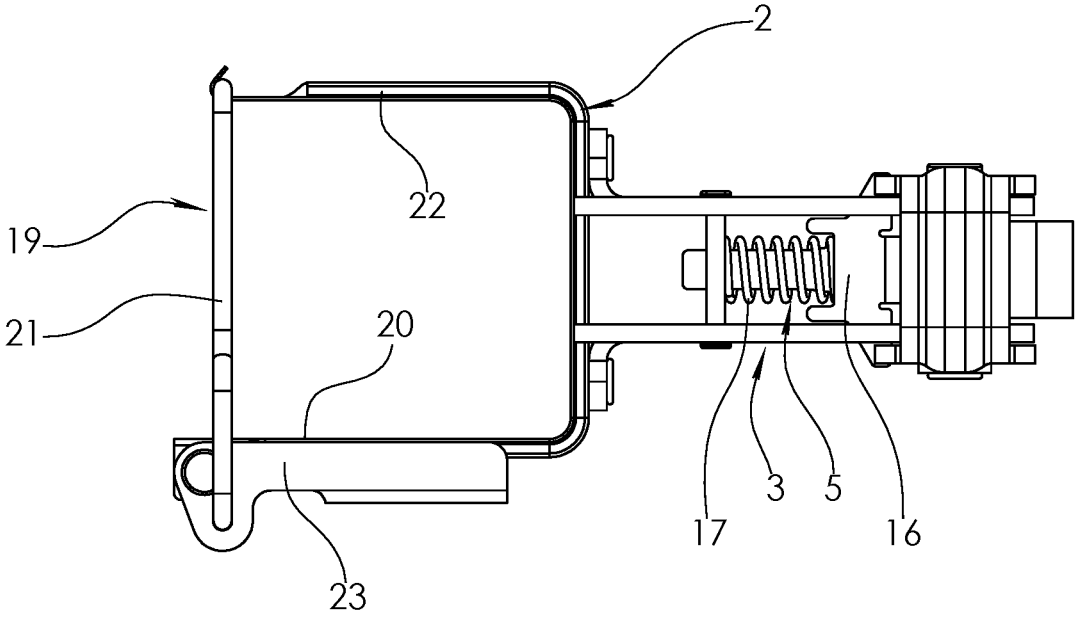
Figure 4:
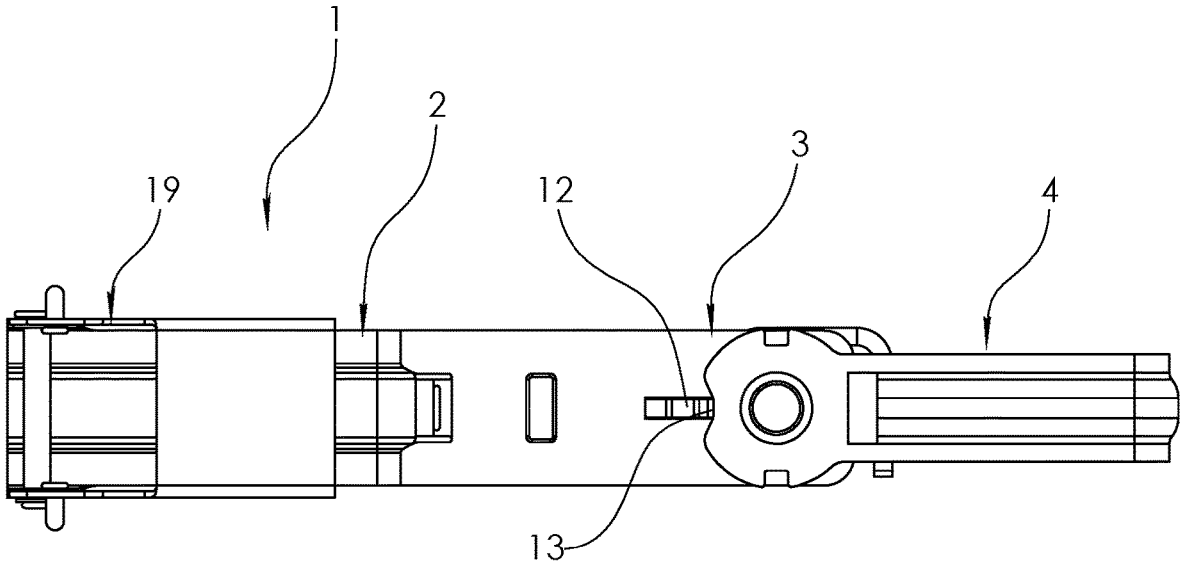

With reference to the figures a mesh panel holder according to the present disclosure will now be described in more detail with reference to exemplifying embodiments. According to a first embodiment thereof the mesh panel holder 1 comprises a post attachment member 2 and a mesh panel support 3 attached to the post attachment member 2. The mesh panel support 3 comprises a mesh panel retainer 4 arranged to pivot between at least a first locked position, shown in FIG. 4, and a second locked position, shown in FIGS. 1, 2 and 3. The mesh panel retainer 4 is positioned at different angles in the first and second locked positions. The mesh panel support 3 further comprises a resilient locking member 5 arranged to lock the mesh panel retainer 4 in the first and second locked positions. In the first locked position the mesh panel retainer 4 is arranged to enable a mesh panel to be received at the mesh panel support 3. For instance, a top frame bar or a horizontal wire of the mesh panel is supported by the mesh panel support 3, see FIGS. 5 and 6. In the second locked position the mesh panel retainer 4 is arranged to prevent a received mesh panel from unintentionally being removed from the mesh panel holder 1. In order to pivot the mesh panel retainer 4 between the locked positions, the resilient locking member 5 is operated to release the mesh panel retainer 4. It should be noted that preferably the mesh panel holder 1 is mounted on a post such that the mesh panel is supported on the ground/floor and does not engage with the mesh panel support 3, merely being held in place by the mesh panel retainer 4. Thereby, the mesh panel holder 1 does not have to carry the weight of the mesh panel/panels.

The mesh panel retainer 4 is elongated, and at one end 7 of the mesh panel retainer 4, constituting a connection end, it is pivotally connected with a support member 6 comprised in the mesh panel support 3. The support member 6 is elongated as well. More particularly, the connection end 7 is provided with a joint, such as a pin joint, connecting the connection end 7 rotatably with a distal end 8 of the support member 6. An opposite proximal end 9 of the support member 6 is rigidly attached to the post attachment member 2, and more particularly to a post bracket 10 comprised in the post attachment member 2. The post bracket 10 is U-shaped, where the legs of the U protrude away from the support member 6. The post bracket 10 is arranged to receive a square post between the legs and, thus, to extend around at least a part of the periphery of the post. As is understood by the person skilled in the art, the shape of the bracket is adapted to the shape of post it is to be mounted at, so other shapes are feasible as well.

When the mesh panel holder 1 is in a mounted state it has been mounted on a post. The post, in turn, has been mounted, for instance, on a floor or between a floor and a ceiling. Thus, the post extends generally vertically. Then, the support member 6 extends generally horizontally in its longitudinal direction. In the first locked position the mesh panel retainer 4 is aligned with the support member 6 and, thus, extends generally horizontally in its longitudinal direction as well. In the second locked position the mesh panel retainer 4 extends generally vertically. In other words, in the second locked position, the mesh panel retainer 4 extends perpendicular to the support member 6. The mesh panel support 3 may be arranged such that in the second locked position the mesh panel retainer 4 protrudes upwards from the support member 6 or downwards from the support member 6. It should be noted that the angle between the mesh panel retainer 4 and the support member 6 in the second locked position can differ from 90 degrees. Any angle between 0 degrees and 180 degrees is theoretically possible to use. However, in practice an angle larger than about 45 degrees and smaller than about 135 degrees is more preferable, and an angle larger than 80 degrees and smaller than 100 degrees is most preferred. The length of the support member 6 should be as short as possible not to extend excessively from the mesh panels, but long enough to enable support of two mesh panels. In a similar way, the mesh panel retainer 4 should preferably not add more than necessary to the total extension of the mesh panel holder 3 laterally of the mesh panels.

The mesh panel holder 1 may be provided with a two-position mesh panel retainer 4. Alternatively, as shown in the Figures, the mesh panel holder 1 may be provided with a three position mesh panel retainer 4, where the first locked position is the one described above, i.e. where the mesh panel retainer 4 extends in alignment with the support member 6, the second locked position is where the mesh panel retainer 4 (with reference to the mounted state) is inclined upwards from the support member 6, and the third locked position is where the mesh panel retainer 4 is inclined downwards from the support member 6, as indicated with broken lines in FIG. 2.

In each position the mesh panel retainer 4 is locked by the resilient locking member 5, and thus not possible to pivot without operating the resilient locking member 5. The resilient locking member 5 may be constructed to make it possible to operate the resilient locking member just by hand. However, for security reasons the resilient locking member 5 may be constructed to necessitate a tool, either a special tool or, preferably, a standard tool such as a screwdriver, to operate it and unlock the mesh panel retainer 4. As an additional option, in the first locked position the locking effect can differ from the locking effect in the other position (s), such that the resilient locking member 5 keeps the mesh panel retainer 4 from pivoting merely by its own weight but enables simple pivoting by hand, while a tool is needed in other positions. This is to facilitate the mounting of the edge protection barrier in that when the mesh panels have been received on the support portions 6, while the mesh panel retainers 4 are in the first locked position, the mesh panels can be easily locked from removal by pivoting the mesh panel retainers 4 by hand to another locked position. The locking is obtained by an engagement between a first engagement portion 11 of the mesh panel retainer 4 and a corresponding, and mating, second engagement portion 12 of the support member 6, and more particularly of the resilient locking member 5 comprised in the support member 6. In this first embodiment the first engagement portion 11 comprises lock portions constituted by recesses 13, 14, 15, one for each locked position. The first engagement portion 11 of the mesh panel retainer 4 comprises a generally circular portion and the recesses 13-15 are located at the periphery of the circular portion at a peripheral distance from each other providing the desired angles of the mesh panel retainer 4 in the different locked positions. The resilient locking member 5 comprises a locking element 16 releasably engaged with the mesh panel retainer 4 in the first and second locked positions, respectively. The locking element 16 comprises the second engagement portion 12, which has a cross-sectional shape that is adapted to the shape of the recesses 13-15. For instance, the cross-section of the second engagement portion may be rectangular. The recesses 14, 15 of the second and third positions may be defined by a bottom surface extending in parallel with an edge surface of the second engagement portion, and two opposite side surfaces extending parallel to each other and perpendicular to the bottom surface, while the recess 13 of the first position has side surfaces leaning away from each other towards the mouth of the recess 13. The second engagement portion 12 may comprise protrusions arranged to extend into the recesses 13-15. Furthermore, the resilient locking member 5 comprises a spring 17, which spring 17 biases the locking element 16, and thus the second engagement portion 12, towards the recesses 13-15. The locking element 16 is guided by an aperture of a guide bar 18 through which a center shaft of the locking element extends. The spring 17 is arranged around the center shaft and abuts against the guide bar 18. Thus, the locking element 16 is reciprocally movable. However, this is a mere example of a resilient locking member solution, and many variations are feasible, some of which will be described below.

The first engagement portion 11 may include two such generally circular portions arranged at opposite ends of a shaft comprised in the pin joint.

An operation member 24 is arranged at the distal end 8 of the support member 6. The operation member 24 is arranged to operate the resilient locking member 5 to unlock the mesh panel retainer 4 to pivot the same between different locked positions. The operation member 24 is used by pushing it, like pushing a button, in direction towards the post attachment member 2.

The post attachment member 2 comprises a clamping member 19 connected with the post bracket 10 and arranged to clamp the post bracket 10 at the post. The clamping member 19 is arranged at a mouth of the post bracket 10. The clamping member 19 comprises a lever 23, pivotally connected at a first end thereof with the post bracket 10, at the end of a first leg 20 of the post bracket 10, and a gate element 21, pivotally connected at one end thereof with the lever 23 at the first end of the lever 23 but offset towards an opposite second end of the lever 23 relative to the connection between the lever 23 and the post bracket 10. The gate element 21 is pivotal between a clamping position where it is engaged with a second leg 22 of the post bracket 10, and covers the mouth of the post bracket 10, and a released position where it is disengaged from the second leg 22 and the mouth of the bracket 10 is open. By pivoting the gate element 21 into engagement with the second leg 22 and then pivoting the lever 23 to a closed position where it extends along the first leg 20, the clamping member 19 is tensioned and clamps the mesh panel holder 1 to the post. Due to the offset position of the connection between the gate element 21 and the lever 23 an eccentric function is obtained and the lever 23 remains in the closed position until operated. Thus, the clamping member 19 constitutes an eccentric lock. The gate element 21 may have a wire shape, where the wire, typically a metal wire, has been bent to a suitable shape, such as a U-shape, to grab the second leg 22. The gate element 21 and/or the first and second legs 20, 22 can be elastic/resilient to some degree in order to firmly clamp the post when the lever 23 is pivoted to the closed position.

Figure 5:
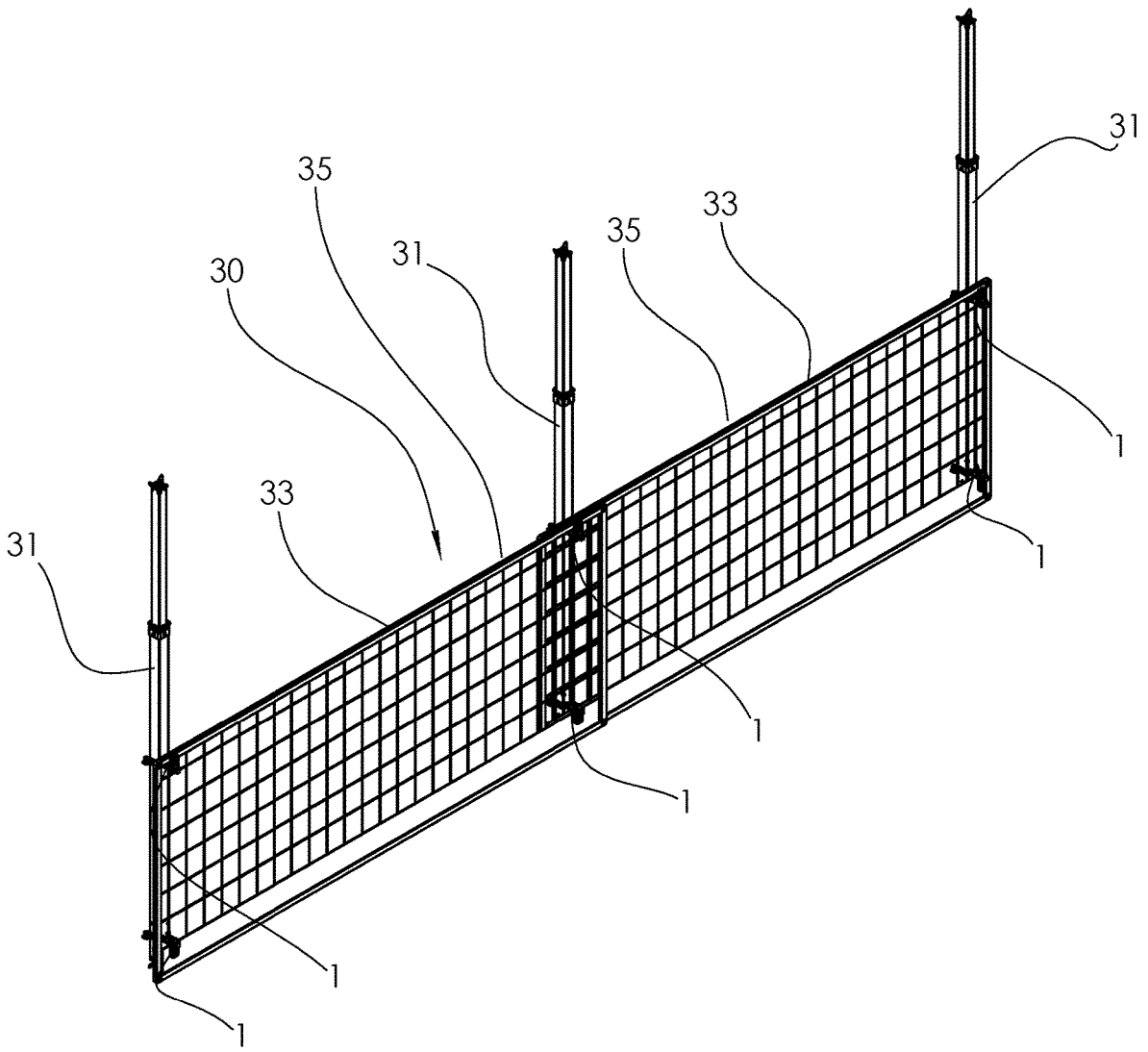
FIG. 5 is a schematic perspective view of an edge protection barrier system including the mesh panel holder.
Figure 6:
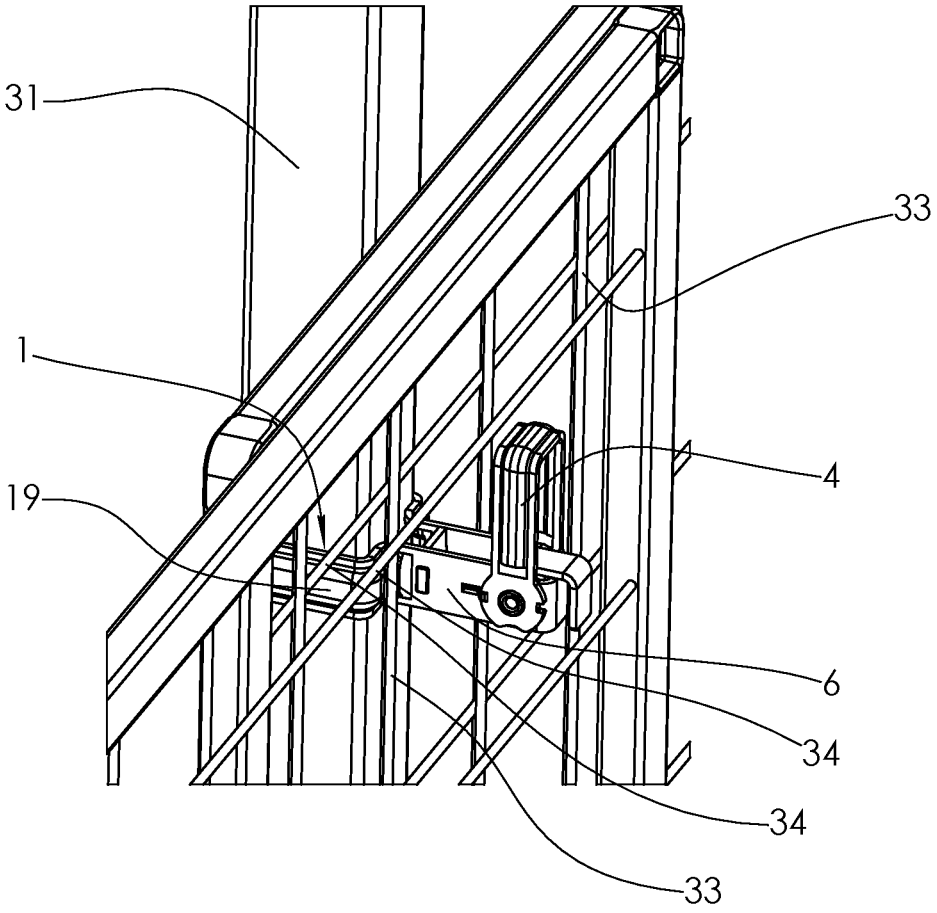
FIG. 6 is an enlarged view of a part of the edge protection barrier system shown in FIG. 5.
Figure 7:
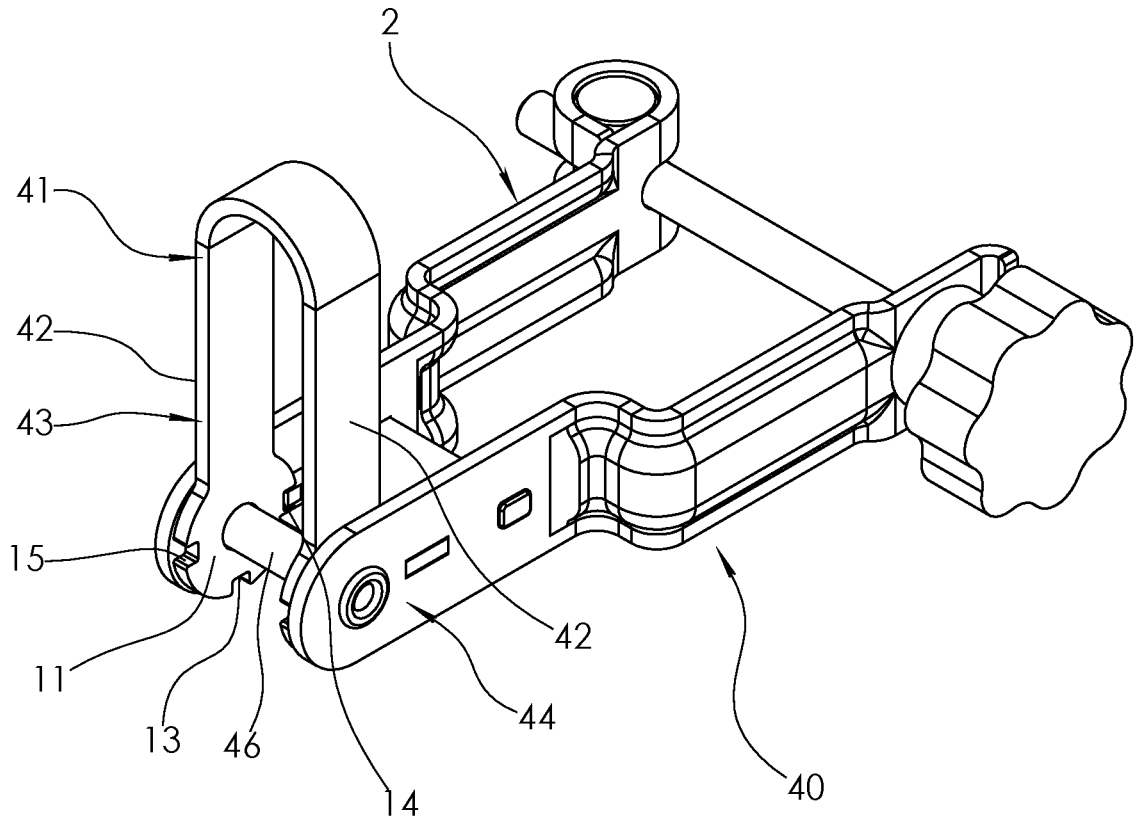
FIGS. 7 to 12 are schematic perspective views of embodiments of a mesh panel holder according to the present disclosure.
Figure 8:
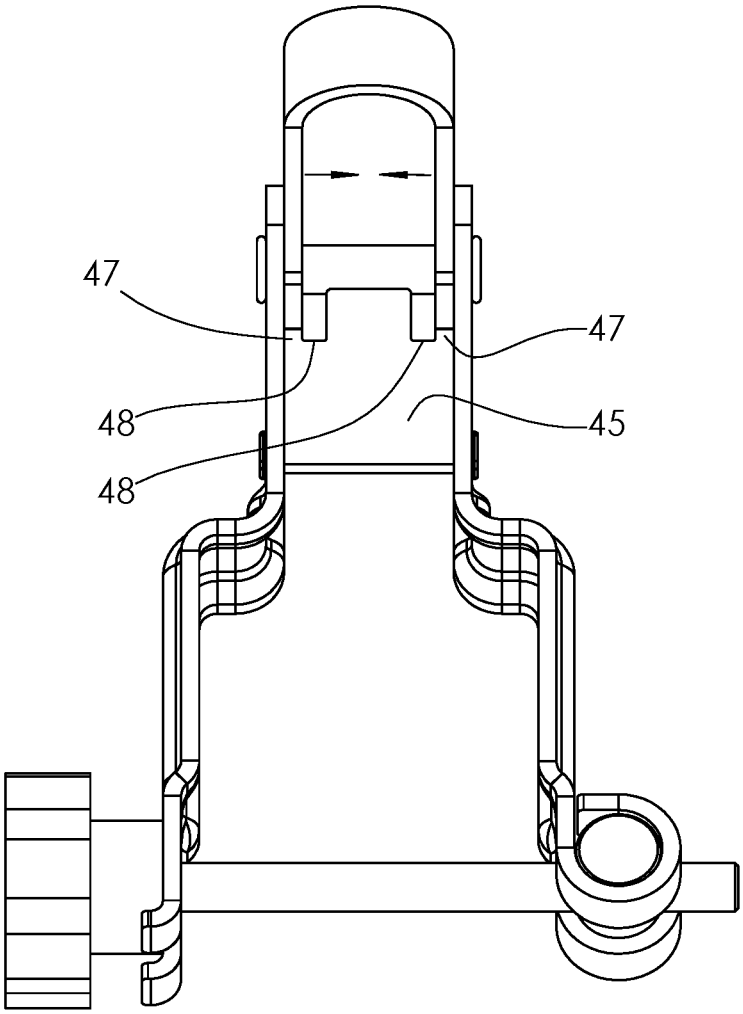
Figure 9:
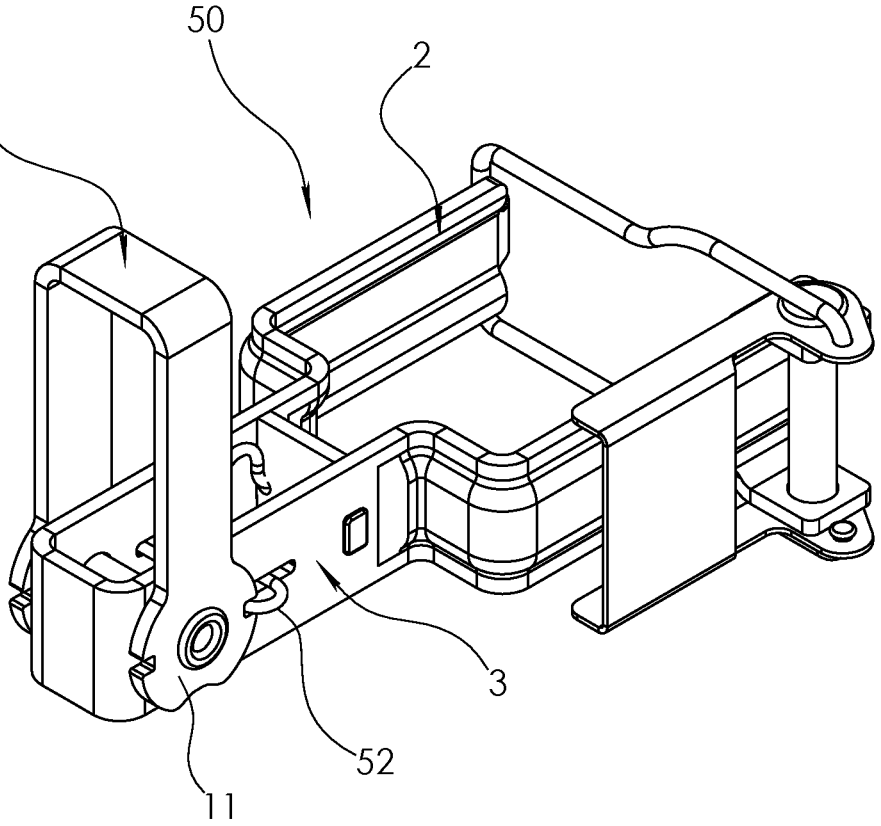
Figure 10:
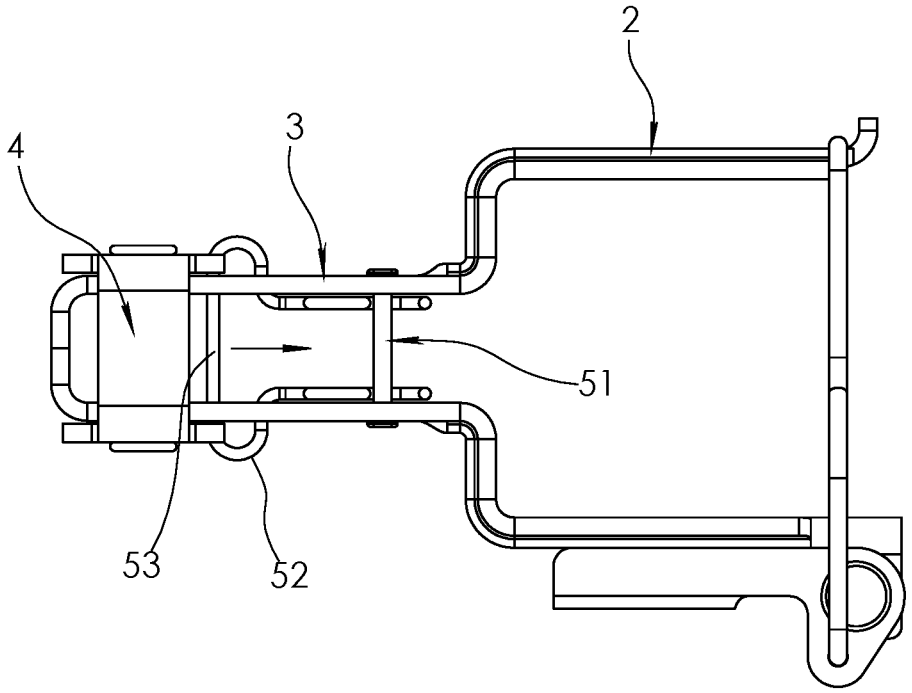
Figure 11:
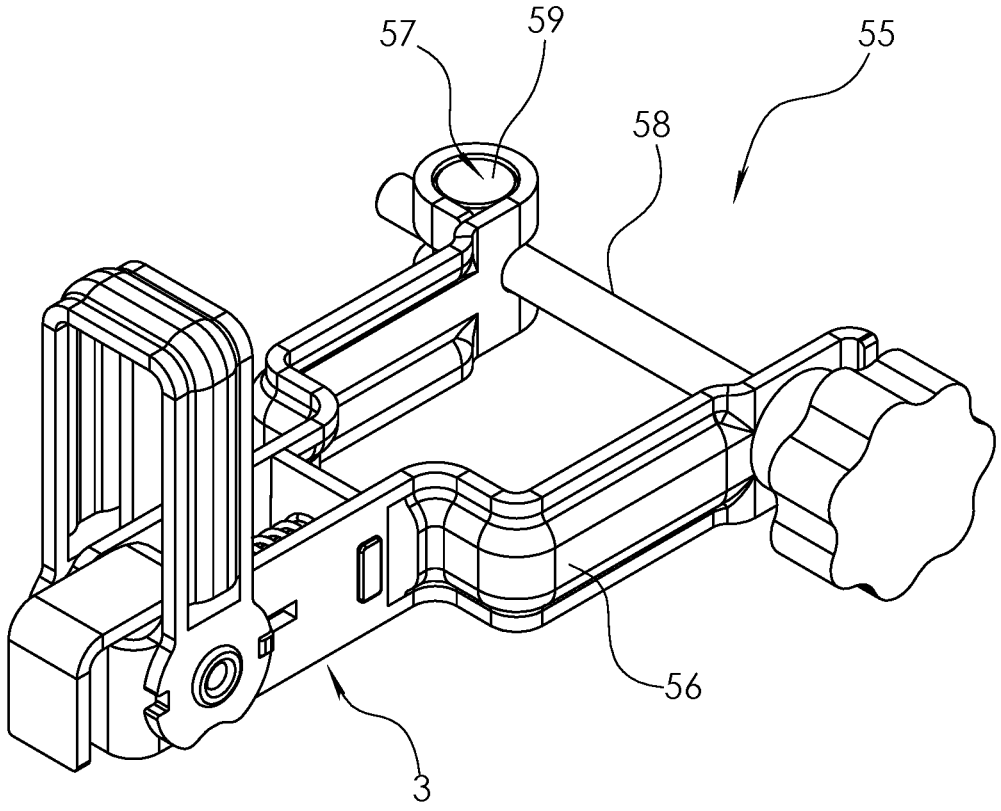
Figure 12:
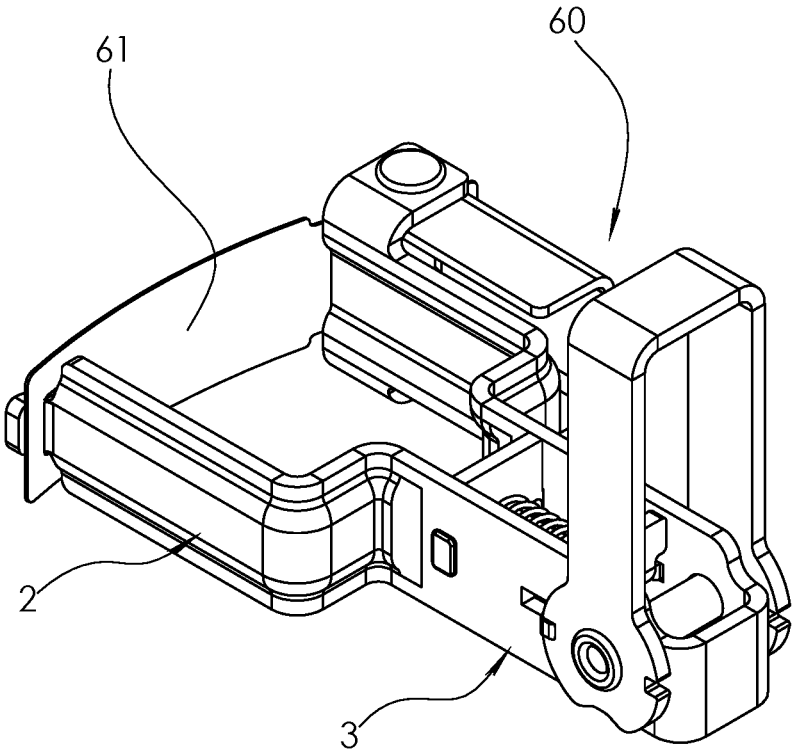

FIG. 5 shows an example of an edge protection barrier system 30, which comprises three posts 31, six mesh panel holders 1 mounted two on each post 31, and two mesh panels 33 mounted on the mesh panel holders 1. A horizontal top frame bar 35 of each mesh panel 33 rests on the same support member 6. FIG. 6 shows an enlarged portion of the edge protection barrier 30, where the mesh panel retainer 4 of the mesh panel holder 1 is in the second locked position where it has been pivoted upwards to retain the mesh panel 33 on the support member 6. However, in this Figure, as an alternative to what is shown in FIG. 5, it is shown that one horizontal wire 34 of each mesh panel 33 rests on the same support member 6. As mentioned above, however, a better mounting alternative is to ensure that the mesh panel holders 1 are mounted on the posts 31 in such positions that the mesh panels 33 rest on the floor and do not engage with the support members 6. Thereby, the mesh panel holders 1 do not have to carry the weight of the mesh panels 33, but merely retain them by means of the mesh panel retainers 4. The relation between the height of the meshes of the mesh panel 33 and the length of the mesh panel retainer 4 may be correlated such that the length of the mesh panel retainer 4 is greater than the vertical distance between two adjacent horizontal wires 34 of the mesh, i.e. the height of a mesh of the mesh panel, thereby ensuring that there is no possibility to remove the mesh panel 33 without unlatching the mesh panel retainer 4 and pivoting it down. This may be true for at least a part of the mesh panel 33, while another part may have larger meshes.

The edge protection barrier 30 is installed as follows. First the posts 31 are mounted on the floor, such as by placing each post in a foot, which is either bolted in the floor or used without bolting, or, when using telescopic post, by extending each post and tensioning it between the floor and the ceiling. Then at least one mesh panel holder 1 is mounted on each post 31. Preferably two mesh panel holders 1 are mounted at different heights of the post 31. The mesh panel retainers 4 of the mesh panel holders 1 are then set in the first locked position, which includes checking that they already are in the first locked position if that is the case. Each mesh panel 33 is mounted on two adjacent posts 31 by pushing it onto the mesh panel holders 1 such that a wire 34 is resting on the support member 6. Typically, the mesh panels 33 are hung in an overlapping way so that a single post 31 is used for carrying the respective ends of two mesh panels 33. Finally, the mesh panel retainers 4 are pivoted to the second locked position, which can be either inclined upwards or inclined downwards from the support member 6.

A second embodiment of the mesh panel holder 40 is similar to the first embodiment, except for some details. According to the second embodiment the resilient locking member 43 comprises two resilient legs 42 of the mesh panel retainer 41. More particularly, the mesh panel retainer 41 is pivotally supported, at one end of the resilient legs 42, on a rigid shaft 46 comprised in the support member 44. Similar to the first embodiment, the first engagement portion 11 of the mesh panel retainer 41 comprises a generally circular portion rotatably connected with the support member 44. More particularly, the mesh panel retainer 41 comprises two generally circular portions respectively arranged at the ends of the resilient legs 42, and the lock portions comprise recesses 13-15 spaced along a periphery of each generally circular portion. The second engagement portion of the locking element 45 comprises protrusions 47 extending into the recesses 13-15 in the first and second locked positions. The locking element 45 is, however, not movable but fixedly attached to the support member 44. As indicated above, the resilient legs 42 are pushed towards each other, to release the mesh panel retainer 41 and enable pivoting of the mesh panel retainer 41 to another locked position. When the resilient legs 42 are pushed towards each other the recesses 14 disengage from the protrusions 47 and are positioned at grooves 48 of the locking element 45 positioned adjacent to the protrusions 47. Thereby, the mesh panel retainer 41 is pivotable to another locked position, where the resilient legs 42 move away from each other again due to the resilience and other recesses 13/15 of the first engagement portion 11 engage with the protrusions 47 of the locking element 45.

A third embodiment of the mesh panel holder 50 is similar to the first embodiment, except for some details. According to the third embodiment the resilient locking member 51 comprises a resilient wire 52, which is mounted at the support member 6 and which has been bent to provide the second engagement portion 53. In order to release the mesh panel retainer 4, the resilient wire 52 is resiliently compressed until the second engagement portion 53 is disengaged from the first engagement portion 11.

A fourth embodiment of the mesh panel holder 55 is similar to the first embodiment, except for some details. According to the fourth embodiment the post bracket 56 is resilient, at least at the mouth, and the gate element 58 of the clamping member 57 comprises a pin having a thread at one end thereof and a head at the other end thereof, thus for example constituting a bolt, and is arranged to, in the closed position, clamp the post bracket 56 at the post by rotating the gate element 58. The pin of the gate element 58 is attached to a threaded seat of a shaft 59, which in turn is rotatably attached to the post bracket 56 at its mouth for providing the pivotability of the gate element 58.

A fifth embodiment of the mesh panel holder 60 is similar to the first embodiment, except for some details. According to the fifth embodiment the gate element 61 is a leaf spring.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A mesh panel holder for an edge protection barrier system comprising mesh panels supported on posts by means of the mesh panel holders, the mesh panel holder comprising a post attachment member and a mesh panel support attached to the post attachment member, wherein the mesh panel support comprises a mesh panel retainer arranged to pivot between at least a first locked position and a second locked position at different pivotal angles, the mesh panel retainer being arranged to, in the first locked position, enable a mesh panel to be received at the mesh panel support, and, in the second locked position, prevent a received mesh panel from being unintentionally removed from the mesh panel holder, wherein the mesh panel holder comprises a resilient locking member, wherein unlocking of the mesh panel retainer from the first and second locked positions requires operation of the resilient locking member, wherein the mesh panel support comprises a support member attached to the post attachment member and arranged to support the mesh panel, wherein the mesh panel retainer is pivotally connected with the support member at an end thereof and comprises a first engagement portion, wherein the support member comprises a second engagement portion arranged to engage with the first engagement portion, wherein the resilient locking member comprises a locking element, which comprises the second engagement portion, which locking element is releasably engaged with the mesh panel retainer at first and second lock portions, which are comprised in the first engagement portion of the mesh panel retainer, in the first and second locked positions, respectively.

2. The mesh panel holder according to claim 1, wherein the mesh panel retainer, in a mounted state of the mesh panel holder, extends generally horizontally in the first position, and extends generally vertically in the second position.

3. The mesh panel holder according to claim 2, wherein the resilient locking member comprises resilient legs of the mesh panel retainer, wherein the resilient legs are arranged to be pushed towards each other to unlock the mesh panel retainer and enable pivoting thereof.

4. The mesh panel holder according to claim 1, wherein the locking member further comprises a spring element engaged with the locking element, wherein the spring element is arranged to keep the locking element in engagement with the mesh panel retainer in the first and second locked positions.

5. The mesh panel holder according to claim 1, wherein the locking element is reciprocally movably arranged at the support member.

6. The mesh panel holder according to claim 1, wherein the first engagement portion comprises a generally circular portion rotatably connected with the support member, and the locking portions comprise recesses spaced along a periphery of the generally circular portion, wherein the locking element comprises protrusions extending into the recesses in the first and second locked positions.

7. The mesh panel holder according to claim 1, wherein the post attachment member comprises a post bracket arranged to extend around at least a part of a periphery of a post.

8. The mesh panel holder according to claim 7, wherein the post attachment member comprises a clamping member connected with the post bracket and is arranged to clamp the post bracket at the post.

9. The mesh panel holder according to claim 8, wherein the post bracket comprises a mouth for receiving the post into the post bracket, and wherein the clamping member further comprises a gate element movable between a closed position where the gate element closes the mouth and an open position where the mouth is open and allows the post to pass the mouth.

10. The mesh panel holder according to claim 9, wherein the post bracket is resilient, at least at the mouth, and the gate element comprises a pin having a thread at one end thereof and a head at the other end thereof, and is arranged to, in the closed position, clamp the post bracket at the post by being rotated.

11. The mesh panel holder according to claim 9, wherein the clamping member constitutes an eccentric lock.

12. The mesh panel holder according to claim 11, wherein the clamping member comprises a lever pivotally attached, at a pivot connection, with the post bracket at the mouth, wherein the gate member is pivotally connected with the lever and eccentrically connected with the lever with respect to the pivot connection.

13. A mesh panel holder for an edge protection barrier system comprising mesh panels supported on posts by means of the mesh panel holders, the mesh panel holder comprising a post attachment member and a mesh panel support attached to the post attachment member, wherein the mesh panel support comprises a mesh panel retainer arranged to pivot between at least a first locked position and a second locked position at different pivotal angles, the mesh panel retainer being arranged to, in the first locked position, enable a mesh panel to be received at the mesh panel support, and, in the second locked position, prevent a received mesh panel from being unintentionally removed from the mesh panel holder, wherein the mesh panel holder comprises a resilient locking member, wherein unlocking of the mesh panel retainer from the first and second locked positions requires operation of the resilient locking member and wherein the resilient locking member comprises resilient legs of the mesh panel retainer, wherein the resilient legs are arranged to be pushed towards each other to unlock the mesh panel retainer and enable pivoting thereof.

14. An edge protection barrier system comprising at least one mesh panel supported on posts by means of mesh panel holders, each mesh panel holder comprising a post attachment member and a mesh panel support attached to the post attachment member, wherein the mesh panel support comprises a mesh panel retainer arranged to pivot between at least a first locked position and a second locked position at different pivotal angles, the mesh panel retainer being arranged to, in the first locked position, enable a mesh panel to be received at the mesh panel support, and, in the second locked position, prevent a received mesh panel from being unintentionally removed from the mesh panel holder, wherein the mesh panel holder comprises a resilient locking member, wherein unlocking of the mesh panel retainer from the first and second locked positions requires operation of the resilient locking member, wherein the mesh panel support comprises a support member attached to the post attachment member and arranged to support the mesh panel, wherein the mesh panel retainer is pivotally connected with the support member at an end thereof and comprises a first engagement portion, wherein the support member comprises a second engagement portion arranged to engage with the first engagement portion, wherein the resilient locking member comprises a locking element, which comprises the second engagement portion, which locking element is releasably engaged with the mesh panel retainer at first and second lock portions, which are comprised in the first engagement portion of the mesh panel retainer, in the first and second locked positions, respectively.

* * * * *